US006791508B2

(12) United States Patent
Berry et al.

(10) Patent No.: US 6,791,508 B2
(45) Date of Patent: Sep. 14, 2004

(54) WIDEBAND CONICAL SPIRAL ANTENNA

(75) Inventors: Sonja A. Berry, Mesa, AZ (US); James R. Gilbert, Mesa, AZ (US)

(73) Assignee: The Boeing Company, Chicago, IL (US)

( * ) Notice: Subject to any disclaimer, the term of this patent is extended or adjusted under 35 U.S.C. 154(b) by 87 days.

(21) Appl. No.: 10/164,485

(22) Filed: Jun. 6, 2002

(65) Prior Publication Data

US 2003/0227422 A1 Dec. 11, 2003

(51) Int. Cl.[7] ..... H01Q 1/36
(52) U.S. Cl. ..... 343/895; 343/749; 343/881
(58) Field of Search ..... 343/745, 749, 343/792.5, 880, 881, 895

(56) References Cited

U.S. PATENT DOCUMENTS

| | | | | | |
|---|---|---|---|---|---|
| 3,246,245 | A | * | 4/1966 | Turner | 455/293 |
| 3,381,297 | A | * | 4/1968 | Zisler et al. | 342/441 |
| 3,424,984 | A | | 1/1969 | Dunlavy, Jr. | |
| 3,447,159 | A | | 5/1969 | Dtromswold | |
| 3,461,455 | A | | 8/1969 | Rowe | |
| 3,475,756 | A | | 10/1969 | Martino | |
| 3,475,758 | A | | 10/1969 | DeVito | |
| 3,482,249 | A | | 12/1969 | Mullaney | |
| 3,514,780 | A | | 5/1970 | Petrick et al. | |
| 3,569,979 | A | | 3/1971 | Munk et al. | |
| 3,573,830 | A | | 4/1971 | Tadama et al. | |
| 3,573,840 | A | | 4/1971 | Gouillow et al. | |
| 3,582,952 | A | | 6/1971 | Heins | |
| 3,587,106 | A | | 6/1971 | Crooks, Jr., et al. | |
| 3,588,905 | A | | 6/1971 | Dunlavy, Jr. | |
| 3,596,273 | A | | 7/1971 | Francis et al. | |
| 3,599,220 | A | | 8/1971 | Dempsey | |
| 3,717,878 | A | | 2/1973 | Mosko | |
| 3,740,753 | A | | 6/1973 | Monola | |
| 3,795,005 | A | | 2/1974 | Moner et al. | |
| 3,808,599 | A | | 4/1974 | Brunner | |
| 3,828,351 | A | | 8/1974 | Voronoff | |
| 3,913,109 | A | * | 10/1975 | Owen | 343/880 |
| 3,940,772 | A | | 2/1976 | Ben-dov | |
| 3,950,757 | A | | 4/1976 | Blass | |
| 4,028,704 | A | | 6/1977 | Blass | |
| 4,475,111 | A | * | 10/1984 | Gittinger et al. | 343/881 |
| 4,504,988 | A | | 3/1985 | Deutchman | |
| 4,675,690 | A | | 6/1987 | Hoffman | |
| 4,680,591 | A | | 7/1987 | Axford et al. | |
| 4,733,243 | A | | 3/1988 | Feigenbaum | |
| 4,750,000 | A | | 6/1988 | Schroeder | |
| 4,825,224 | A | | 4/1989 | Grose et al. | |
| 4,890,116 | A | | 12/1989 | Lewis, Jr. | |
| 4,907,012 | A | | 3/1990 | Trumble | |
| 4,945,363 | A | | 7/1990 | Hoffman | |
| 5,216,436 | A | * | 6/1993 | Hall et al. | 343/895 |
| 5,218,372 | A | | 6/1993 | Cheng | |
| 5,346,300 | A | | 9/1994 | Yamamoto et al. | |
| 5,517,206 | A | | 5/1996 | Boone et al. | |
| 5,587,719 | A | | 12/1996 | Steffy | |
| 5,604,507 | A | | 2/1997 | Openlander | |
| 5,635,945 | A | | 6/1997 | McConnell et al. | |
| 5,761,812 | A | | 6/1998 | Feldman | |
| 5,909,197 | A | * | 6/1999 | Heinemann et al. | 343/895 |
| 6,011,524 | A | * | 1/2000 | Jervis | 343/895 |
| 6,259,420 | B1 | * | 7/2001 | Bengtsson et al. | 343/895 |
| 6,583,768 | B1 | | 6/2003 | Underbrink | 343/893 |

* cited by examiner

*Primary Examiner*—Tan Ho
(74) *Attorney, Agent, or Firm*—Harness Dickey & Pierce P.L.C.

(57) ABSTRACT

A spiral antenna having a horizontal member that terminates wires for conducting and radiating signals provides increased efficiency over the HF transmission range in a smaller size construction. A load having a parallel RLC circuit is provided at about the center of the horizontal member. The wires are provided in an elliptical pattern with the spacing between wires provided arithmetically. The wires are further configured symmetrically around a vertical support member. A balun transformer is also provided for impedance matching with a feed line.

24 Claims, 2 Drawing Sheets

WIDEBAND CONICAL SPIRAL ANTENNA

FIELD OF THE INVENTION

The present invention relates generally to antennas, and more particularly to conical spiral antennas for use in high frequency, high bandwidth, skywave non-line-of-sight communications in connection with mobile and stationary systems.

BACKGROUND OF THE INVENTION

High Frequency (HF), high data rate radios typically require wide bandwidth antennas to provide communication. In order to achieve this broadband communication, known antennas are constructed very large to provide efficiency over the wide frequency range, but as a result, are inconvenient for use when mobility is needed (e.g., communications in remote areas). Small antennas are also known to provide HF communication when mobility is important. However, these antennas suffer from transmission inefficiencies, particularly at lower frequencies in the HF bandwidth (i.e., 2 Megahertz (MHz) to 6 MHz).

In general, antennas operate based on resonance and are constructed to provide communication at a fairly narrow frequency bandwidth. In order to communicate on a specific frequency bandwidth for use in communication via a particular radio system, an antenna must be properly tuned to provide acceptable signal transmission levels at those frequencies. Typically, depending upon the frequency bandwidth on which transmissions will occur or are desired, the physical length of wire for conducting (i.e., radiating signals) is adjusted and properly tuned (e.g., loaded) to be resonant on the selected frequency. Additionally, the overall impedance of the system must be matched (i.e., antenna and feed line matched).

In the HF frequency range, in order to provide an antenna resonant at one full wavelength at the lower end of the range (e.g., 3 MHz), the conducting wires would be about the length of a football field. In most situations providing this length is not possible (e.g., in a backyard) or practical, and in cases when it is possible (e.g., in an open field), it is usually inconvenient, as the antenna needs to be capable of easy setup and portability. As a result, antennas have been developed that operate using a length of wire that is a portion of the full wavelength (e.g., ¼ or ½). This is typically accomplished by loading the antenna to affect its electrical characteristics, thereby making the antenna appear longer (i.e., electrically longer) in order to communicate at the lower frequencies.

Further, in certain circumstances, such as, for example, in providing military tactical communications, non-line-of-sight (NLOS) transmissions are needed. In these circumstances, spiral conical antennas providing circular polarization are used to overcome obstacles between, for example, a base station and a receiver on a mobile unit (e.g., helicopter). In particular, propagation of a signal with a very high radiation angle (i.e., Near Vertical Incidence Skywave (NVIS)) to establish tactical communication (i.e., 0–300 kilometers) is desirable. However, such antenna systems for use in mobile situations typically have very limited effective bandwidth range for operation, and generally suffer from transmission inefficiencies at lower frequencies in the HF range. Present linear polarization systems have significant null zones when the transmit and receiving antennas are incorrectly aligned.

Known spiral antennas for providing communication with high frequency, high data rate radios are not effective to provide reliable communications due to antenna problems, particularly in NVIS applications. Thus, these antennas fail to provide effective NLOS communications for use in supporting, for example, military tactical communications with helicopters, cargo planes or fighter planes. Existing spiral antennas are larger in size in order to accommodate the lower frequencies and wide bandwidths particularly in NVIS communications. Further, in aircraft applications, present HF aircraft antennas must be linearly polarized due to aerodynamic considerations.

Thus, there exists a need for a spiral antenna capable of providing HF communications with high bandwidth, circular polarization, and a gain pattern optimized for NVIS communications. Such an antenna must be adapted for easy portability (i.e., small in size) and set-up, while providing efficient and reliable communication at all frequencies in the HF range without the need for constant adjustments for different frequency transmissions.

SUMMARY OF THE INVENTION

The present invention provides an antenna and method of providing the same that is smaller in size while allowing efficient NLOS communication over the HF transmission range. For example, the invention reduces the size and weight needed for a ground station antenna to support military tactical communications (i.e., NLOS communications) with helicopters, cargo planes or fighter planes. With circular polarization of the ground station and the extra gain provided by the antenna of the present invention, alignment of the aircraft antenna with respect to the ground antenna is not required. Thus, the radio can be used anytime and at any aircraft heading and is more efficient in NVIS applications regardless of the signal bandwidth.

The present invention provides an antenna for use in communication systems operating in frequency bands traditionally occupied by narrowband radios, including high frequency (HF), very high frequency (VHF), and ultrahigh frequency (UHF) bands, as well as systems operating in frequencies extending into the millimeter wave region. The antenna allows for these systems to support broad-based and highly mobile communications "on-the-move" and performs in environments of impressive diversity, from dense foliage to dense urban obstructions, and unintentional and intentional jamming. Thus, increased performance and decreased size of the antenna operating in the HF, VHF, UHF, and microwave frequency bands is provided.

Generally, an antenna of the present invention provides NVIS communication that uses circular polarization to eliminate fading as the polarity of the antenna is rotated in the horizontal plane, such as, for example, while on a mobile unit. By reducing the ground wave or horizontally directed energy, greater frequency reuse is obtained over a smaller geographical area (i.e., tactical communications range). With control of transmitted power, the received signal can have a greatly improved bit-error rate. Further, signals transmitted by the antenna are virtually undetectable (i.e., low probability of intercept) on a spectrum analyzer at any bandwidth at the receive end after the signal bounces off the ionosphere.

The antenna is capable of quick (e.g., less than two hours) and easy set-up using less resources (e.g., less people and heavy equipment). In connection with a properly configured HF radio/modem, the present invention provides efficient NLOS voice or data transmission (i.e., high speed data and voice transmission and reception) without regard to receiver (e.g., aircraft receiver) azimuth position over the HF range. For example, wideband video and data may be transmitted and received in a tactical NLOS environment from a helicopter to a Tactical Operations Center (TOC) without a satellite and with low probability of intercept or jamming (e.g., if used with a digital direct-sequence spread spectrum (DSSS) or other waveform transmitter). In operation, by the time a signal comes down from the ionosphere, the signal is often below the ambient noise for non-digital-signal-processing radios. Further, the antenna is adapted to restore communication links when the receiver is not line-of-sight.

Specifically, the present invention provides a conical spiral antenna having a horizontal member at the base of the antenna for terminating a conductor (e.g., wires for conducting and radiating signals) of the antenna, and a load provided at the center of the horizontal member, which allows for more efficient communication over the entire HF range. The conical spiral antenna has improved efficiency and smaller size, and provides the conductor, which preferably includes first and second elements electrically separated from each other, configured in a conical spiral arrangement for transmitting and receiving signals. The horizontal member is adapted for terminating the conductor to thereby provide improved conducted and radiated efficiency for received and transmitted signals.

The conical spiral antenna includes terminating means connected to the conductor (i.e., an end of each of the first and second elements) for providing specific operating characteristics for the conductor, and specifically, a load is provided at the center of the horizontal member. In a more preferred construction, the load comprises a parallel RLC circuit. A vertical support member also may be provided orthogonally to the ground or a ground support (e.g., flat base member on the ground), with the conductor arranged around the vertical support member to provide a conical spiral configuration. The conductor may be configured in a symmetrical spiral arrangement around the vertical support member with arithmetical spacing between spirals of the conductor. Further, the conductor may be configured in an elliptical arrangement.

The antenna may further include a transformer provided at the top of the vertical support member. The transformer provides impedance matching (i.e., transformation) between a feed line and the conductor.

Another construction of a conical spiral antenna of the present invention may be provided and adapted for portability and improved efficiency in operation over the HF transmission range. The conical spiral antenna includes a vertical support member (e.g., telescoping mast) configured orthogonally to a surface on which it is mounted, a conical spiral conductor, which may include first and second elements that are electrically separated, configured in a symmetrical elliptical pattern around the vertical support member, and having arithmetically spaced spirals, a horizontal member at the base of the antenna adapted to terminate the conical spiral conductor, and a load at about the center of the horizontal member. The load provides improved transmission efficiency with a parallel RLC circuit.

The conical spiral antenna further may include a balun transformer at a top of the vertical support member. A feed line may be connected directly between the balun transformer and a transmitting unit for transmitting signals over the HF range. In one exemplary construction, the conical spiral wound conductor decreases in elliptical size extending up the vertical support member (i.e., from the base to the top).

A method of the present invention for constructing a spiral antenna adapted for easy transportation and providing improved operation over the HF transmission range includes configuring a conductor in a symmetrical conical spiral arrangement, with each spiral having an elliptical shape, and providing a horizontal member at the base of the conductor for terminating the conducting wires. The conductor may include wires for conduction and radiation of signals that may be spaced arithmetically around a vertical support member (e.g., a mast), which is mounted orthogonally to the ground or other mounting surface. The method further may include providing a load having a parallel RLC circuit at about the center of the horizontal member. The conductor may comprise first and second elements electrically separated and connected at the load.

Thus, the present invention provides a conical spiral antenna having a horizontal member at its base with a load for terminating a conductor (e.g., wires for conduction and radiation). The antenna is easy to set-up, smaller in size and more efficient over the entire HF range. NLOS communication adapted for NVIS transmission is provided using circular polarization, thereby resulting in improved efficiency and reliability.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. Thus, although the application of the present invention as disclosed herein is generally directed to a conical spiral antenna having a specific configuration and component parts, it is not so limited, and changes in configuration and component parts are contemplated.

Generally, the present invention provides a smaller spiral antenna particularly for use in NLOS communications, which provides increased efficiency in NVIS transmissions. For example, the present invention may be used in providing wideband tactical NLOS communications for nap-of-the-earth attack helicopters, such as, for example, the Apache Longbow® and the Commanche. In such communications, the present invention would allow routing of wireless tactical information through a TOC using an appropriately configured antenna as described herein. With a wideband DSSS HF radio onboard an Apache Longbow® or Commanche, high data rate information, including voice and video, may be transmitted or received through the reception capabilities of the antenna without regard to aircraft azimuth position. Thus, improved flexibility is provided.

Figure 1:
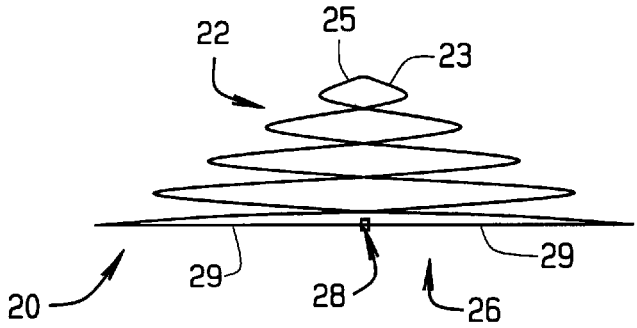
FIG. 1 is a side elevation view of a spiral antenna constructed according to the principles of the present invention.
Figure 2:
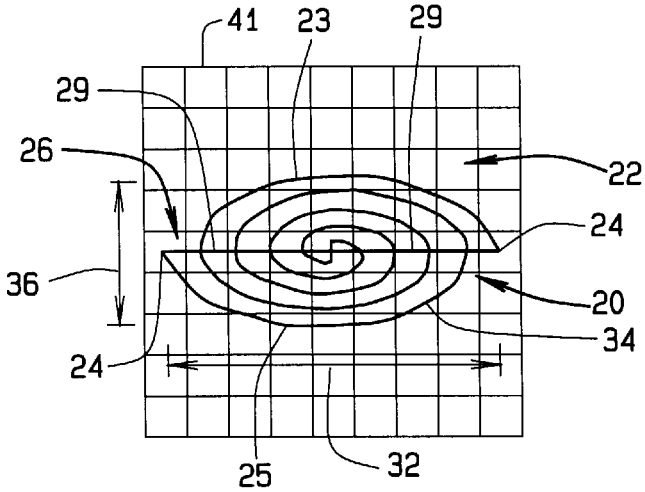
FIG. 2 is a top plan view of a spiral antenna of the present invention.
Figure 3:
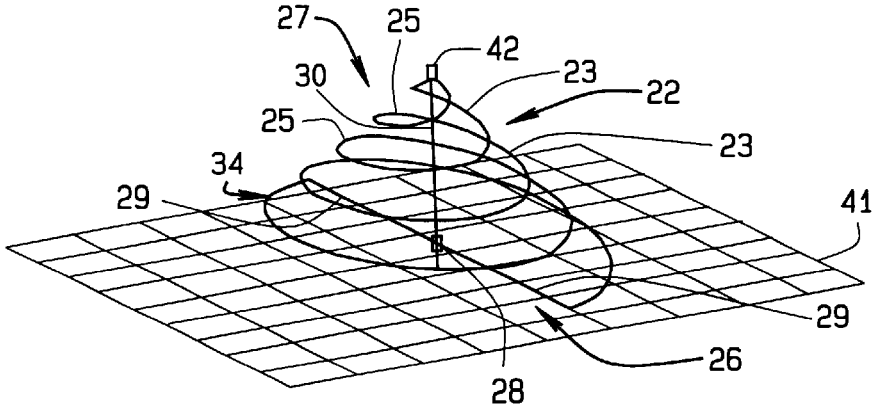
FIG. 3 is a top perspective view of a spiral antenna of the present invention.

Specifically, and as shown in FIGS. 1 through 3, a conical spiral antenna of the present invention is indicated generally therein by reference numeral 20. As shown, the antenna 20 generally includes a conductor 22, which may comprise, for example, conducting wires arranged in a coiled or spiral configuration, with each end 24 of the conductor 22 terminating at a horizontal member 26. More specifically, the conductor 22 includes a first element 23 and a second element 25 for conducting and radiating signals. Each of the first element 23 and second element 25 include a coiled or spiral portion 27 and a horizontal portion 29. The horizontal portion 29 of the first element 23 and second element 25 together form a horizontal member 26 with an end 24 of each of the horizontal portion 29 of the first element 23 and second element 25 terminating at a load 28 located at about the center of the horizontal member 26. It should be noted that the first element 23 and second element 25 are electrically separate from each other, including the horizontal portion 29 of each of these elements. Further, the horizontal portions 29 are electrical extensions of the coiled or spiral portions 27 of the first and second elements 23 and 25.

Figure 5:
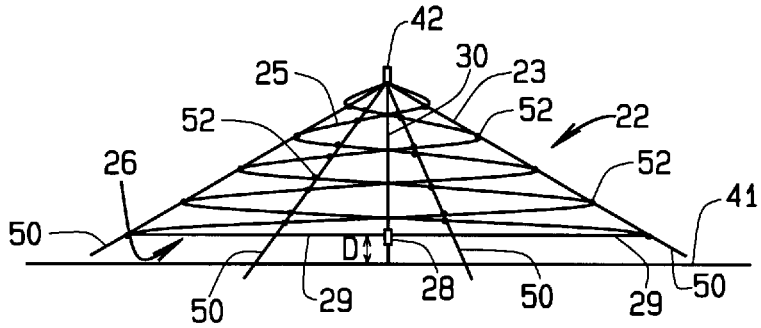
FIG. 5 is a side elevation view of an exemplary construction of the spiral antenna of the present invention.

In one preferred embodiment, the conductor 22 is configured symmetrically spiraling around a vertical support member 30 (e.g., a Carrymast CTM10 telescopic mast or other non-conductive support mast) as shown in FIGS. 3 and 5, with a generally conical shape that decreases in size in the upward vertical direction (i.e., up the mast). As shown therein, the vertical support member 30 is provided orthogonally (i.e., perpendicular) to a ground plane 41, and may be mounted, for example, directly on the ground or on some other base member. For example, a flat base surface may be used for mounting the antenna 20, such as directly to a deck of a ship. However, other structures on which to mount the antenna 20 are possible depending upon the particular application, and include, for example, a floating platform over water that keeps the shape of the antenna. Further, the antenna may be suspended between trees without needing a center support. Also, the platform may be conductive and constructed of a material, such as, for example steel, or non-conductive and constructed of a material such as, for example wood. Further, the conductor 22 is preferably provided in an arithmetically spaced configuration, and is also preferably constructed in an elliptical shape as shown in FIGS. 2 and 3.

Figure 4:
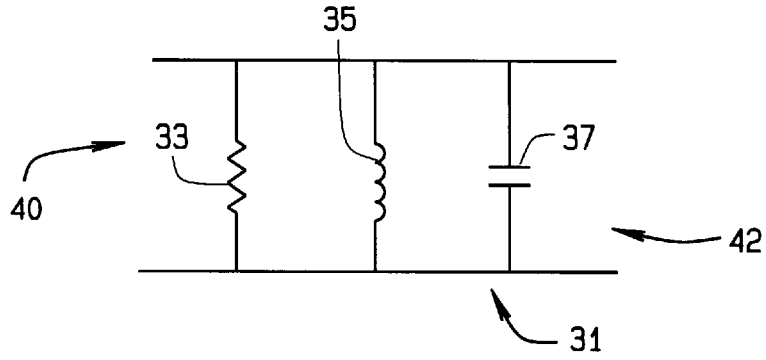
FIG. 4 is a schematic diagram of a load for an antenna of the present invention.

The load 28 for terminating the conductor 22 (i.e., the horizontal portion 29 of the first and second elements 23 and 25) includes a circuit for modifying the electrical characteristics of the antenna 20. In a more preferred embodiment, the load 28 includes a parallel RLC circuit 31, having a resistor 33, an inductor 35 and a capacitor 37 connected in parallel as shown in FIG. 4. In a more preferred construction, one side 40 of the parallel RLC circuit 31 terminates the end 24 of the first element 23 and the other side 42 terminates the end 24 of the second element 25, to thereby electrically connect the first and second elements 23 and 25.

One exemplary construction for providing an antenna 20 according to the principles of the present invention includes the following dimensions:

Major axis 32 of the first (i.e., bottom) elliptical spiral 34 having a length of thirty-two meters;

Minor axis 36 of the first (i.e., bottom) elliptical spiral 34 having a length of fourteen meters; and Vertical support member 30 having a length of ten meters.

In this exemplary construction, the conductor 22 is provided in an arithmetically spaced configuration with a total height of ten meters above ground. Essentially, the vertical dimension of the antenna 20 is nine meters with the horizontal member 26 being one meter above ground. Further, the vertical spacing between the same element's loops (i.e., between loops on the first element 23 or between loops on the second element 25) is preferably about 4 meters and the vertical spacing between the loops of separate elements (i.e., between loops of the first element 23 and second element 25) is preferably about 2 meters. Along the major axis 32, the horizontal spacing between the same element's loops is preferably about 6.88 meters. The horizontal spacing between the two element's loops is preferably about 3.44 meters on the major axis 32. Along the minor axis 36, the horizontal spacing between the same element's loops is preferably about 3.33 meters. The horizontal spacing between the loops of separate elements is preferably about 1.66 meters on the minor axis 36. However, it should be noted that the antenna 20 is not limited to the specific dimensions described above, but may be modified and constructed according to the specific communication and physical size requirements of the particular system.

In this exemplary construction, the parallel RLC circuit 31 preferably includes components with the following values:

Resistor 33 is about 4000 ohm;

Inductor 35 is about 70 microHenry; and

Capacitor 37 is about 10 picoFarad.

It should be noted that in this construction, horizontal member 26 may be a length of wire, for example, #14 AWG wire. Further, the load 28 may be attached to the vertical support member 30.

As shown in FIGS. 3 and 5, each of the elements 23 and 25 spiral around the vertical support member 30 and meet (i.e. are connected) at the load 28 (i.e., center load). The RLC circuit 31 is preferably enclosed within a protective member (e.g., PVC member) to protect the components (e.g., from rain). The enclosed RLC circuit 31 is attached to the base of the vertical support member 30 at a distance D above the ground plane 41, and is preferably approximately one meter from the ground plane 41 in the exemplary construction as shown in FIG. 5. It should be noted that the RLC circuit 31 may be mounted in different orientations on the vertical support member 30, including either vertically or horizontally relative to the vertical support member 30.

Figure 6:
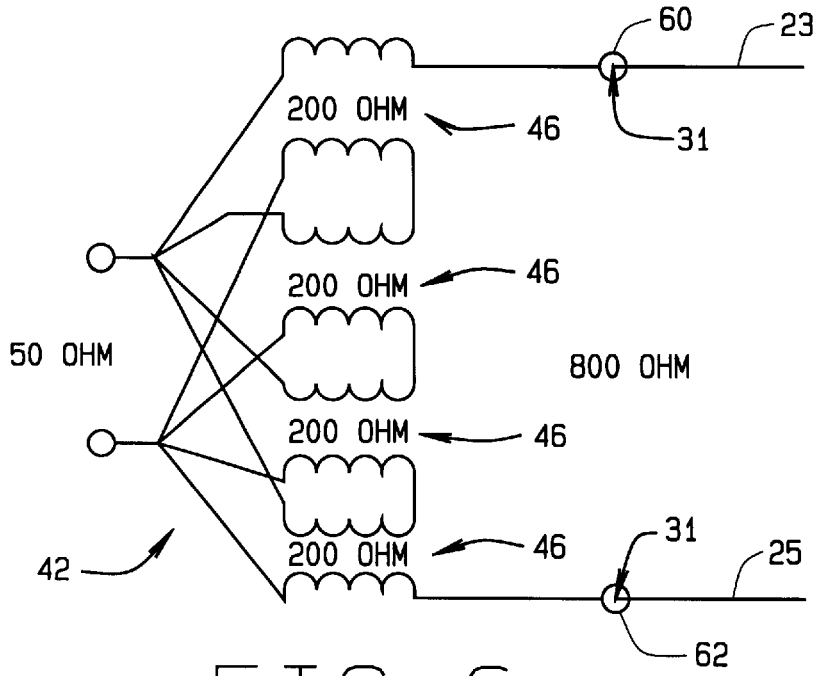
FIG. 6 is a schematic diagram of a balun transformer of the present invention.

The spacing of the turns of the conductor 22 results in a higher than normal impedance at the feed point at the apex (i.e., top of vertical support member 30) of the conductor 22. A balun transformer 42 is provided at the apex for impedance matching (i.e., transformation from 800 Ohm to 50 Ohm) and to allow for connection directly to a standard 50 Ohm coaxial line (i.e., feed line) from, for example, a transmitter. In one exemplary construction as shown in FIG. 6, the balun transformer 42 is a transmission line transformer having a 16:1 balun that matches the load 28 to the characteristic impedance of the transmission line via a 800:50 ohm transformer. The balun transformer 42 as shown uses four toroids 46 (e.g., Amidon FT-240-K toroids) wound in one quarter inch spacing wherein the characteristic impedance per core is 200 ohms. Further, and as shown in FIG. 6, eighteen gauge Formvar wire is preferably wrapped in fourteen bifilar turns per core. Also, an end 31 of each of the first and second elements 23 and 25 are connected to connectors 60 and 62, respectively.

The balun transformer 42 is preferably mounted on the top of the vertical support member 30. Support lines 50 (e.g., ropes) support the conductor 22, including, for example, the separate elements 23 and 25. Connection members 52 (e.g. plastic clips) connect the conductor 22 (i.e., first and second elements 23 and 25) to the support lines 50. A 50 Ohm coax cable, for connection to, for example, a transmitter, preferably extends vertically up the vertical support member 30 to the balun transformer 42.

Thus, the antenna 20 is configured to operate over the HF frequency spectrum from 2 megahertz to 30 megahertz. Also, because the antenna 20 is configured to transmit and receive any frequency within this range, no radio used with the antenna 20 will require a tuner to electrically compensate (i.e., tune) the antenna 20 to receive or transmit on a HF frequency.

The present invention provides a portable conical spiral antenna that is easy to set up, and with increased average gain over the HF range, as well as increased efficiency. Use of the antenna allows for more reliable NLOS communications via NVIS transmissions. Further, the improved transmission characteristics are accomplished in a physically smaller antenna.

Although the present invention has been described in connection with an antenna having a specific wire arrangement with particular component parts, it is not so limited, and the shape and spacing of the wires may be modified as needed. Further, the component parts, including the load, may be modified in accordance with the present invention as needed.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A conical spiral antenna comprising:

a conductor member configured in a conical spiral arrangement for transmitting and receiving signals; and a horizontal member provided at a base of the conductor member, including an RLC load disposed on the horizontal member, the RLC load connected to the conductor at the horizontal member, and adapted for terminating the conductor member to thereby provide improved conducted and radiated efficiency for the signals.

2. The conical spiral antenna according to claim 1, wherein the RLC load is a parallel RLC load at about the center of the horizontal member.

3. The conical spiral antenna according to claim 1, wherein the conductor member comprises conducting wires and further comprising a vertical support member with the conducting wires configured around the vertical support member to provide the conical spiral arrangement.

4. The conical spiral antenna according to claim 3, wherein the conducting wires are configured in a symmetrical spiral arrangement around the vertical support member.

5. The conical spiral antenna according to claim 4, wherein the conducting wires are arithmetically spaced.

6. The conical spiral antenna according to claim 3, wherein the conducting wires are configured in a generally elliptical arrangement.

7. The conical spiral antenna according to claim 3, wherein the vertical support member is configured orthogonally with respect to a mounting surface.

8. The conical spiral antenna according to claim 1, wherein the conductor member comprises a first element and a second element, the first and second elements electrically separated and connected at the load.

9. The conical spiral antenna according to claim 8, wherein the first and second elements each comprise a spiral portion and a horizontal portion with the horizontal portion of each of the first and second elements forming the horizontal member.

10. A conical spiral antenna adapted for portability and improved efficiency in operation over a high frequency transmission range, the conical spiral antenna comprising:

a collapsible vertical support member configured orthogonally to a mounting surface on which the vertical support member is mounted;

a conical spiral conductor configured in a generally symmetrical elliptical pattern around the collapsible vertical support member, and having arithmetically spaced spirals;

a horizontal base member adapted to terminate the conical spiral conductor at a base of the conical spiral conductor; and a load at about the center of the horizontal base member, the load including a parallel RLC circuit.

11. The conical spiral antenna according to claim 10, wherein the collapsible vertical support member comprises a telescoping mast.

12. The conical spiral antenna according to claim 11 further comprising a balun transformer at a top of the telescoping mast.

13. The conical spiral antenna according to claim 12, wherein a feed line is adapted to be connected directly between the balun transformer and a communication unit for transmitting and receiving signals over the high frequency range.

14. The conical spiral antenna according to claim 10, wherein the conical spiral conductor decreases in elliptical size extending up the vertical support member with the base winding having a major axis of about 32 meters and a minor axis of about 14 meters.

15. The conical spiral antenna according to claim 14, wherein the parallel RLC circuit comprises a resistor of about 4000 ohm, an inductor of about 70 microHenry and a capacitor of about 10 picoFarad connected in parallel.

16. The conical spiral antenna according to claim 10, wherein the conical spiral conductor comprises a first element and a second element electrically separate from each other.

17. The conical spiral antenna according to claim 16, wherein each of the first and second elements comprise a spiral portion and a horizontal portion, the horizontal portion of each of the first and second elements forming the horizontal base member.

18. A method of constructing an antenna adapted for ease in setup and transportation and providing improved operation over the high frequency transmission range, the method comprising the steps of:

configuring a conductor in a symmetrical conical spiral arrangement, with each spiral having a generally elliptical shape;

providing a horizontal member at a base of the conductor for terminating the conductor; and providing a load having an RLC circuit disposed on the horizontal member.

19. The method according to claim 18, wherein the conductor comprises wires for conducting and radiating signals, and further comprising spacing the wires arithmetically.

20. The method according to claim 18 wherein the RLC circuit is a parallel RLC circuit at about the center of the horizontal member.

21. The method according to claim 18 further comprising providing a vertical support member orthogonally to a mounting surface.

22. The method according to claim 18, wherein the conductor comprises a first element and a second element, and further comprising electrically separating the first and second elements.

23. A conical spiral antenna comprising:

a vertical support member;

a conductor member including conducting wires configured around the vertical support member in a conical spiral arrangement for transmitting and receiving signals;

a horizontal member adapted for terminating the conductor member to thereby provide improved conducted and radiated efficiency for the signals; and a transformer provided at a top of the vertical support member for impedance transformation between a feed line and the conducting wires.

24. A method of constructing an antenna adapted for ease in setup and transportation and providing improved operation over the high frequency transmission range, the method comprising the steps of:

configuring a conductor in a symmetrical conical spiral arrangement, with each spiral having a generally elliptical shape, the conductor including a first element and a second element;

electrically separating the first and second elements; and providing a horizontal member at a base of the conductor for terminating the conductor, the first element and the second element electrically connected at a load provided at about the center of the horizontal member.

* * * * *